US008891988B2

(12) United States Patent
Takahashi et al.

(10) Patent No.: US 8,891,988 B2
(45) Date of Patent: Nov. 18, 2014

(54) IMAGE FORMING APPARATUS AND IMAGE FORMING METHOD INCLUDING AN ALARM THAT, UNDER A PREDETERMINED CONDITION, INDICATES THAT A FRONT SIDE AND A BACK SIDE OF THE RECORDING PAPER ARE INVERTED

(75) Inventors: Kenji Takahashi, Osaka (JP); Tsutomu Yoshimoto, Osaka (JP); Shuhji Fujii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 174 days.

(21) Appl. No.: 13/600,428

(22) Filed: Aug. 31, 2012

(65) Prior Publication Data

US 2013/0114966 A1 May 9, 2013

(51) Int. Cl.

| | |
|---|---|
| ***G03G 15/20*** | (2006.01) |
| ***G03G 15/16*** | (2006.01) |
| *G03G 15/01* | (2006.01) |

(52) U.S. Cl.

CPC ..... *G03G 15/1695* (2013.01); *G03G 15/0136* (2013.01)

USPC ..... 399/67

(58) Field of Classification Search

CPC ..... G03G 15/161; G03G 15/2014; G03G 2215/0059; G03G 2215/00666; G03G 2215/1666; G03G 2215/1671

See application file for complete search history.

(56) References Cited

U.S. PATENT DOCUMENTS

| | | | | |
|---|---|---|---|---|
| 7,343,125 | B2 * | 3/2008 | Miyake | 399/299 |
| 8,014,038 | B2 * | 9/2011 | Okano | 358/400 |
| 2006/0245801 | A1 | 11/2006 | Shibuya | |
| 2013/0051823 | A1 * | 2/2013 | Harashima et al. | 399/38 |

FOREIGN PATENT DOCUMENTS

| | | |
|---|---|---|
| JP | 04-315162 | 11/1992 |
| JP | 04-358189 A | 12/1992 |
| JP | 2006-071803 | 3/2006 |
| JP | 2006-309061 | 11/2006 |
| JP | 2007-271681 | 10/2007 |
| JP | 2010-175975 | 8/2010 |

OTHER PUBLICATIONS

Extended European Search Report for corresponding European Application No. 12006415.9 issued on Mar. 5, 2013.

* cited by examiner

*Primary Examiner* — Clayton E Laballe
*Assistant Examiner* — Victor Verbitsky
(74) *Attorney, Agent, or Firm* — Renner, Otto, Boisselle & Sklar, LLP

(57) ABSTRACT

An image forming portion has a transfer portion for transferring a toner image formed on an image carrier onto the recording paper, and a fixing portion for heating and compressing the recording paper on which the toner image is transferred to fix the toner image to the recording paper. A control portion controls to heat and compress the recording paper by the fixing portion without performing transfer of the toner image by the transfer portion to smooth the recording paper under predetermined condition. At this time, the control portion is able to set variably the number of times to pass through the fixing portion without performing transfer of the toner image onto the recording paper and pressure force when the recording paper passes through the fixing portion.

3 Claims, 13 Drawing Sheets

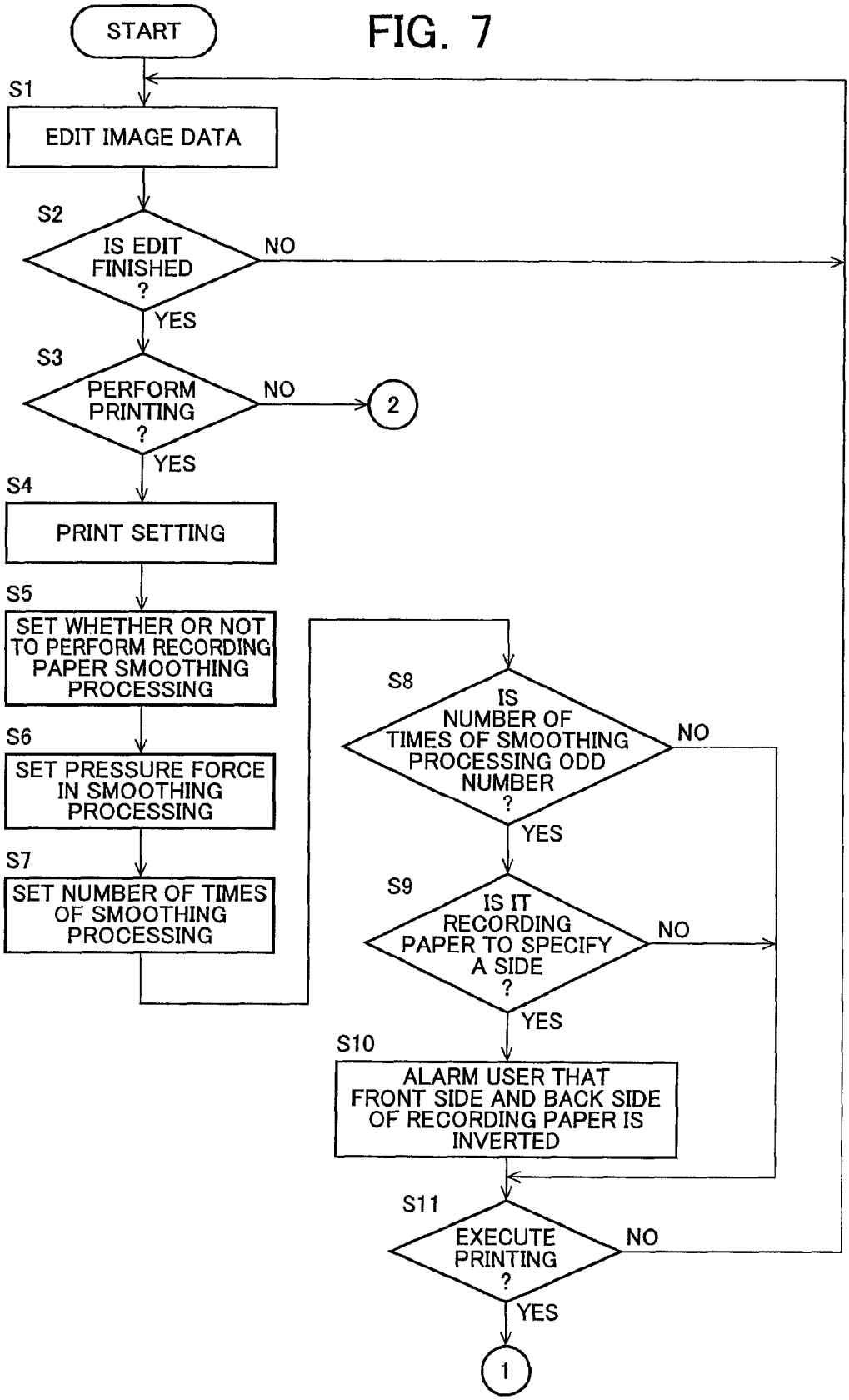
FIG. 7
START
S1
EDIT IMAGE DATA
S2
IS EDIT FINISHED ?
NO
YES
S3
PERFORM PRINTING ?
NO
2
YES
S4
PRINT SETTING
S5
SET WHETHER OR NOT TO PERFORM RECORDING PAPER SMOOTHING PROCESSING
S6
SET PRESSURE FORCE IN SMOOTHING PROCESSING
S7
SET NUMBER OF TIMES OF SMOOTHING PROCESSING
S8
IS NUMBER OF TIMES OF SMOOTHING PROCESSING ODD NUMBER ?
NO
YES
S9
IS IT RECORDING PAPER TO SPECIFY A SIDE ?
NO
YES
S10
ALARM USER THAT FRONT SIDE AND BACK SIDE OF RECORDING PAPER IS INVERTED
S11
EXECUTE PRINTING ?
NO
YES
1

IMAGE FORMING APPARATUS AND IMAGE FORMING METHOD INCLUDING AN ALARM THAT, UNDER A PREDETERMINED CONDITION, INDICATES THAT A FRONT SIDE AND A BACK SIDE OF THE RECORDING PAPER ARE INVERTED

CROSS-NOTING PARAGRAPH

This non-provisional application claims priority under 35 U.S.C. §119(a) on Patent Application No. 2011-244192 filed in JAPAN on Nov. 8, 2011, the entire contents of which are hereby incorporated herein by reference.

FIELD OF THE INVENTION

The present invention relates to an image forming apparatus and an image forming method, more specifically, to an image forming apparatus for performing image formation by transferring a toner image formed on an image carrier to a recording paper and heating and fixing thereafter, and an image forming method.

BACKGROUND OF THE INVENTION

In an image forming apparatus in an electrostatic copying system capable of multicolor image formation, such as a color copier or a color printer, image formation is performed by forming toner images of respective colors on latent image carriers such as photoreceptor drums, transferring these toner images to an intermediate transfer belt sequentially to form a multicolor image, and then transferring and fixing the multicolor image to a recording paper.

The recording paper used for image formation has various quality and forms. As a recording paper generally used for a printer and a copier, a recording paper supplied by a manufacturer of the copier or the like is used, whereas in developing countries and the like, for example, an inexpensive recording paper used in that country is used. Some of recording paper is worse and has surface asperity, and also its size, quality and the like are different from a standard recording paper recommended by the manufacturer.

In addition, an embossed paper subjected to embossing finish intentionally on the surface of the paper so as to have subtle irregularity such as a pear skin like pattern, a cloth like pattern, or a silk like pattern is known. Alternatively, there is also a recording paper that is used in a form of being folded in two or in three. For example, a card board used for an invitation to a wedding, an event or the like is shipped in a state of being folded in two during papermaking, and it becomes necessary to perform printing on such a paper folded in two. Even in the case of the recording paper in a state of being folded once in this manner, irregularity is partially caused on the surface thereof.

When printing is performed for the recording paper having various quality and forms as described above, performing image formation processing by an electrophotographic system as described above allows a large quantity of printing processing at a low price. However, in the case of the recording paper whose surface is worse or having a large irregularity by embossing, for example, there is a problem that the intermediate transfer belt is not able to sufficiently contact with the whole surface of the recording paper due to irregularity of the surface, thus lowering a transfer ratio of a toner and causing deterioration of image quality.

In addition, when a paper folded in two is printed, surface contact between a transfer member and the recording paper becomes uneven in the vicinity of a folding line of the recording paper, so that there is a problem that excellent transfer is not able to be performed in the vicinity of the folding line, thus causing deterioration of image quality.

As to a printing technology for addressing such paper quality and forms, for example, Japanese Laid-Open Patent Publication No. 4-315162 discloses an image forming apparatus aiming to obtain a clear image excellent in fixing property of a toner with respect to many kinds of papers for image formation. In this image forming apparatus, surface smoothness of a paper is measured by a paper smoothness measuring portion, and when the smoothness is lower than a predetermined level, an image forming operation is not performed and the paper is passed being sandwiched between a heat roller and a pressure roller for smoothing, and then guided to a path for duplex copy, followed by image formation.

When the above image formation by an electrostatic copying system is performed for a recording paper whose surface roughness is rough (large degree of irregularity) as described above, it is difficult to cause the surface of the recording paper to contact with the smooth intermediate transfer belt uniformly and stably, thus posing a problem that image quality is deteriorated significantly depending on the state of the recording paper.

Against these problems, such a measure is taken that, for example, an adhesion amount of a toner for performing image formation is increased or transfer current is increased to facilitate transfer of a multicolor image on the intermediate transfer belt to a recording paper. However, problems are caused that when the adhesion amount of a toner is increased, an image such as a character becomes in the swollen state on the recording paper to deteriorate image quality, and when the transfer current is increased, retransfer is caused due to overcurrent transfer to deteriorate image quality. Accordingly, merely by adjusting image forming conditions, it is impossible to address recording papers with various surface states sufficiently.

Moreover, in the case of a recording paper with a folding line, printing is performed in a state where the recording paper that is shipped with a folding line is unfolded. For example, a recording paper shown in FIG. 15A is in a state of being folded in three, which needs to be made in an open state as shown in FIG. 15B when being printed. In this case, a trace of the folding line is not able to be eliminated sufficiently only by smoothing out with a hand of a user, so that the folding line part is floated from the intermediate transfer belt to cause transfer failure.

For example, when an outward of a folding line is caused to contact with the intermediate transfer belt, the vicinity of the outward of the folding line is floated from the intermediate transfer belt to be separated therefrom. In addition, when printing the inward of the folding line, the vicinity of the inward of the folding line becomes impossible to contact with the intermediate transfer belt. Even when image formation is performed with the folding line opened in this manner, image deterioration is caused due to transfer failure at the folding line part or in the vicinity of the folding line. In particular, a stiff card board is often used for the recording paper for an invitation to an event or the like, and the folding line part is not able to be smoothed, so that deterioration of image quality is caused easily. Accordingly, such a design is conventionally made that image formation is not performed in the vicinity of the folding line part.

In contrast, as shown in Japanese Laid-Open Patent Publication No. 4-315162, in accordance with smoothness of a recording paper subjected to image formation, by passing through a fixing portion without performing image formation to pressure and heat the recording paper by the fixing portion, it is possible to smooth the recording paper to some extent.

However, in the case of smoothing the recording paper by passing through the fixing portion, for example, when a card board is passed through the fixing portion plural times, the card board has a peculiarity to be curled so that a problem is caused that a jam rate is increased in a conveyance path. In addition, when a thin paper is passed through the fixing portion, a problem is caused that pressure force of the fixing portion is too large to generate wrinkles on the thin paper to cause failure. That is, even when smoothing the recording paper by the fixing portion, it is necessary to perform fixing under the condition corresponding to characteristics of the recording paper. A technical idea about such optimization is not disclosed in Japanese Laid-Open Patent Publication No. 4-315162.

SUMMARY OF THE INVENTION

The present invention aims to provide an image forming apparatus capable of performing high-quality image formation without image deterioration, even for a recording paper whose surface smoothness is low because of quality or a form of the recording paper, by making it possible to transfer an image formed on an intermediate transfer member to the recording paper reliably and stably, and an image forming method.

An object of the present invention is to provide an image forming apparatus comprising a recording paper conveying portion for conveying a recording paper, an image forming portion for performing image formation on the recording paper conveyed by the recording paper conveying portion, and a control portion for controlling the recording paper conveying portion and the image forming portion, wherein the image forming portion has a transfer portion for transferring a toner image formed on an image carrier onto the recording paper, and a fixing portion for heating and compressing the recording paper on which the toner is transferred to fix the toner image to the recording paper, and the control portion controls to heat and compress the recording paper by the fixing portion without performing transfer of the toner image by the transfer portion under a predetermined condition, and is able to set variably the number of times to pass through the fixing portion without performing transfer of the toner image onto the recording paper and pressure force of the fixing portion when the recording paper passes through the fixing portion.

Another object of the present inventions is to provide the image forming apparatus, wherein the recording paper conveying portion has a conveyance path for conveying the recording paper heated and compressed by the fixing portion to the transfer portion again, and the control portion conveys the recording paper heated and compressed by the fixing portion without performing transfer of the toner image by the transfer portion to the transfer portion again under the predetermined condition.

Another object of the present inventions is to provide the image forming apparatus, wherein when the number of times to pass the recording paper through the fixing portion is set to be a plural number of times of twice or more, the control portion repeats a control the set number of times, to pass through the fixing portion without performing transfer of the toner image onto the recording paper, and then convey the recording paper to the transfer portion by the conveyance path and pass through the fixing portion without performing transfer of the toner image onto the recording paper by the transfer portion.

Another object of the present inventions is to provide the image forming apparatus, wherein when the number of times to pass the recording paper through the fixing portion without performing transfer of the toner image by the transfer portion is set to be the odd number of times, under the predetermined condition, the control portion gives an alarm that a front side and a back side of the recording paper are inverted due to setting of the odd number of times using predetermined means.

Another object of the present inventions is to provide the image forming apparatus, wherein the transfer portion has a plurality of image carriers, an intermediate transfer belt for transferring the toner image formed on the plurality of image carriers, a transfer roller for transferring the toner image transferred to the intermediate transfer belt onto the recording paper, and a driving mechanism portion for causing the image carriers and the intermediate transfer belt to be in contact with or separated from each other, and the driving mechanism portion separates the image carriers and the intermediate transfer belt from each other under the predetermined condition.

Another object of the present inventions is to provide an image forming method executed by an image forming apparatus including a transfer portion for transferring a toner image formed on an image carrier onto a recording paper, and a fixing portion for heating and compressing the recording paper on which the toner image is transferred to fix the toner image to the recording paper, comprising a step of heating and compressing the recording paper by the fixing portion without performing transfer of the toner image by the transfer portion, and a transfer step of conveying the recording paper that is heated and compressed to the transfer portion to transfer the toner image onto the recording paper, and wherein the number of times to pass through the fixing portion without performing transfer of the toner image onto the recording paper and pressure force of the fixing portion when the recording paper passes through the fixing portion are able to be set variably at the step of heating and compressing without performing transfer of the toner image.

BRIEF DESCRIPTION OF THE DRAWINGS

FIG. 7 is a flowchart for describing exemplary image formation processing in the image forming apparatus according to the present invention;

PREFERRED EMBODIMENTS OF THE INVENTION

Figure 1:
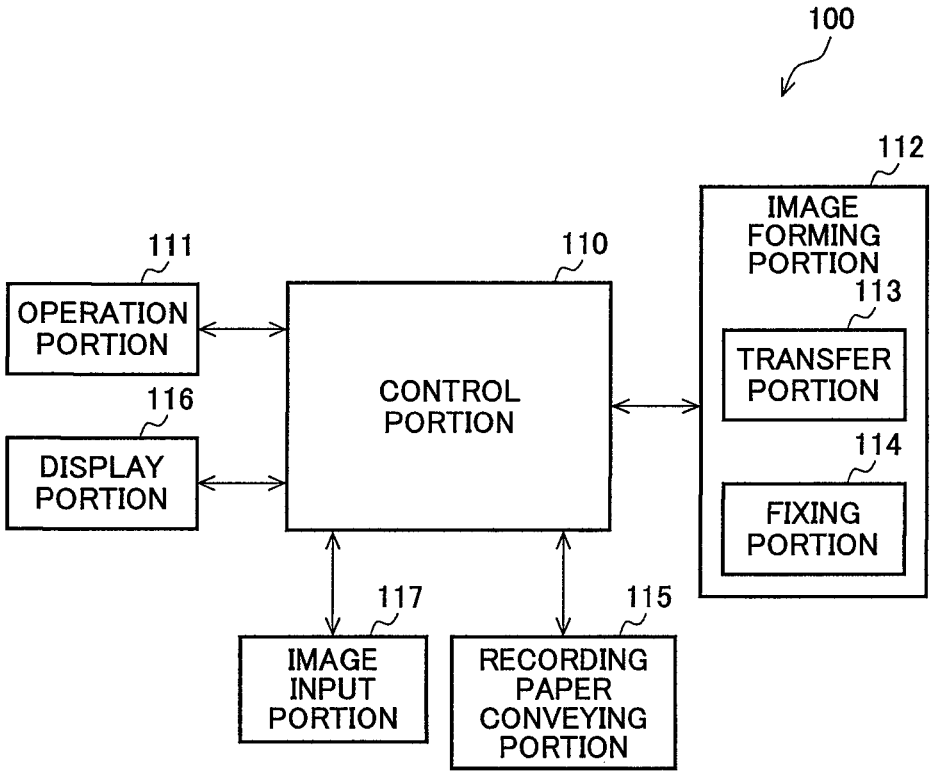
FIG. 1 is a block diagram showing a configuration of main portions of an image forming apparatus according to the present invention.

FIG. 1 is a block diagram showing a configuration of main portions of an image forming apparatus according to the present invention. An image forming apparatus 100 performs image formation of image data that is transmitted from outside or read by image reading means such as a scanner on a recording paper, and is an image forming apparatus in an electrostatic copying system that performs image formation by forming monochrome or multicolor toner images on latent image carriers such as photoreceptor drums, transferring these toner images sequentially to an intermediate transfer belt to form an image, and then transferring and fixing the image to the recording paper.

A control portion 110 controls each function of the image forming apparatus and is realized by means of a micro computer having a CPU, a ROM, a RAM and the like inside.

An operation portion 111 receives operation input by a user to output to the control portion 110. In addition, a display portion 116 displays a screen for an operation and various kinds of information. A touch panel allowing input operations for an operation screen is able to be configured by the operation portion 111 and the display portion 116.

An image input portion 117 inputs image data that is input from an information processing apparatus or the like connected from outside or image data that is output from a scanner portion (image reading means) or a recording medium reading portion for reading image data from a transportable recording medium, which is not shown and is able to be provided in the image forming apparatus.

An image forming portion 112 performs image formation (printing) of image data on a recording paper in accordance with control of the control portion 110 and has a transfer portion 113 and a fixing portion 114. At the transfer portion 113, toner images based on image data are formed on a plurality of image carriers such as photoreceptor drums and the formed toner images are transferred onto an intermediate transfer belt. In addition, the toner images on the intermediate transfer belt are transferred onto a recording paper being conveyed. At the fixing portion, the recording paper having the toner images transferred thereto is heated and compressed by a heat roller and a compress roller and the toner images are fixed onto the recording paper for image formation.

A recording paper conveying portion 115 controls conveyance of a recording paper subjected to image formation. The recording paper is placed on a paper feed tray not-shown and conveyed from a predetermined conveyance path to the image forming portion 112 for image formation. As the conveyance path, a conveyance path in which a recording paper fed from the paper feed tray is ejected by passing through the transfer portion 113 and the fixing portion 114 of the image forming portion 112 sequentially and a duplex printing conveyance path in which a front side and a back side of the recording paper that has passed through the fixing portion 114 are inverted to be carried to the transfer portion 114 again are provided. By using the duplex printing conveyance path, it is possible to perform image formation by the transfer portion 113 in a state where a front side and a back side of the recording paper that has been heated and compressed once at the fixing portion 114 are inverted. The recording paper conveying portion 115 performs switching of the above conveyance paths and changing of a conveyance speed in accordance with control of the control portion 110.

In an embodiment according to the present invention, using the above configuration, smoothing processing for improving smoothness is performed for a recording paper whose surface is worse, such as an embossed paper or a recording paper with a holding line, by conveying the recording paper to the fixing portion 114 without performing image formation by the transfer portion 113 and heating and compressing the recording paper by the fixing portion 14. In addition, the recording paper is then carried to the transfer portion 113 using the duplex conveyance path to perform image formation of target image data. Thereafter, though fixing processing is performed by the fixing portion 114 for ejection, it is possible to perform duplex printing using the duplex conveyance path again as necessary.

Moreover, in this case, by heating and compressing the recording paper by the fixing portion 114, then carrying the recording paper to the fixing portion 114 again using the duplex conveyance path and repeating heating and compressing processing plural times, it is possible to execute processing for improving smoothness as appropriate in accordance with the state of the recording paper. The number of times to pass through the fixing portion 114 repeatedly is able to be set by a user. In addition, in the heating and compressing processing in the fixing portion 114, pressure force is able to be set by the user. These setting functions make it possible to set the optimum number of times of fixing processing and pressure force at that time in accordance with characteristics of a recording paper to be used, and a toner is able to be transferred to recording papers with various surface roughness reliably and stably, so that it becomes possible to perform high-quality image formation without image deterioration.

Moreover, in the image forming apparatus according to the present invention, when the number of times to pass the recording paper through the fixing portion 114 is the odd number of times, a front side and a back side of the recording paper are inverted when the toner image is transferred by the transfer portion 113, so that alarming means for alarming that effect is provided. The alarming means is realized as appropriate in accordance with a system of giving an alarm thereof. For example, alarm display is performed on the display portion 116, an alarm is given by the control portion 110 and the display portion 116. In addition, when an alarm is given by sound output, not-shown sound output means such as a speaker is provided. Alternatively, when an alarm is given to an external device by communication, not-shown predetermined communication means is provided.

Since the transfer portion 113, the fixing portion 114, the recording paper conveying portion 115 and the like of the image forming portion 112 described above are generally configured to be provided in a multi-functional peripheral as standard, the above processing is able to be executed only by changing firmware in the multi-functional peripheral and the embodiment according to the present invention is able to be performed easily without increasing costs.

Figure 2:
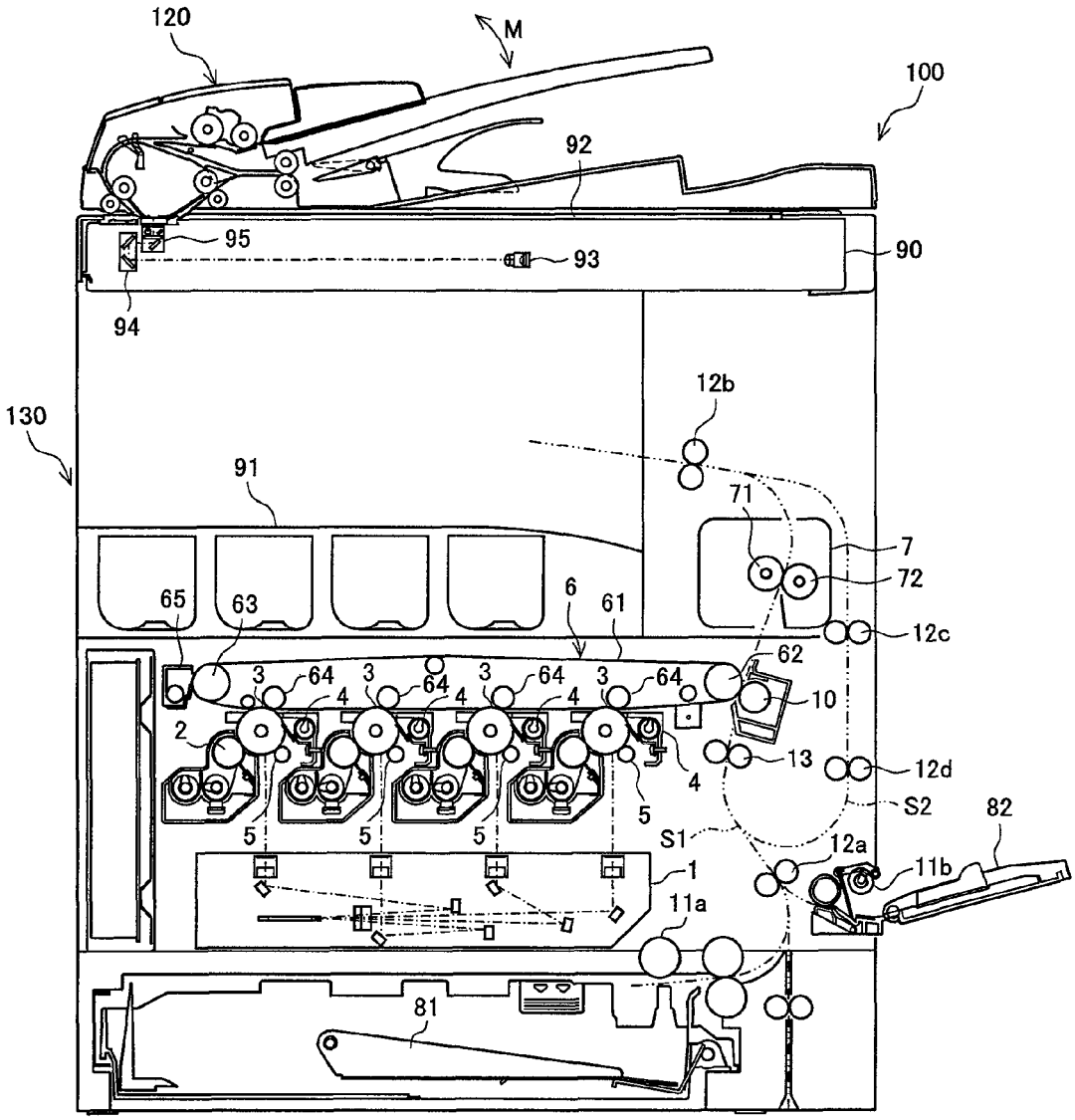
FIG. 2 is a view showing an embodiment in which the image forming apparatus according to the present invention is configured as a multi-functional peripheral.

FIG. 2 is a view showing an embodiment in which the image forming apparatus according to the present invention is configured as a multi-functional peripheral, and shows an example of the image forming apparatus configured as a multi-functional peripheral having a scanner function.

The image forming apparatus 100 performs image formation of image data that is transmitted from outside or read by a scanner (image reading means) on a recording paper, and is configured by a main apparatus body 130 and an automatic document processing device 120.

The main apparatus body 130 has an exposure unit 1, a developing device 2, a photoreceptor drum 3, a cleaner unit 4, a charging device 5, an intermediate transfer belt unit 6, a fixing unit 7, a paper feed cassette 81, a paper output tray 91 and the like.

A document loading table 92 made of a transparent glass is provided on a top of the main apparatus body 130, and at an upper side thereof, the automatic document processing device 120 that conveys a document onto the document loading table 92 automatically is attached. The automatic document processing device 120 is configured so as to rotate freely in a direction of an arrow M and opens the top of the document loading table 92, so that a document is able to be placed manually thereon.

The main apparatus body 130 has image reading means 90 stored in a housing. The image reading means 90 is image reading means of a reduced optical system configured by a light source unit 93 that holds a light source and a first mirror, a mirror unit 94 that holds second and third mirrors, a lens, and a CCD 95. In addition, the main apparatus body 130 is provided with a not-shown operation panel so as to allow a user to perform operation input. The operation panel corresponds to the operation portion 111 and the display portion 116. Moreover, the main apparatus body 130 is provided with means for inputting image data from an apparatus that is externally connected, or means for reading image data from a transportable recording medium (each of which is not shown).

Image data handled in the image processing apparatus 100 corresponds to color images of four colors of, for example, black (K), cyan (C), magenta (M) and yellow (Y). Accordingly, four developing devices 2, four photoreceptor drums (image carriers) 3, four charging devices 5 and four cleaner units 4 are provided respectively to form four kinds of latent images corresponding to the respective colors, thereby forming four imaging stations.

The charging devices 5 are charging means for uniformly charging the surfaces of the photoreceptor drums 3 to a predetermined potential, and contact type chargers including roller type and brush type chargers are also used, other than the charger type as shown in FIG. 2.

The exposure unit 1 is configured as a laser scanning unit (LSU) provided with a laser emitting portion, a reflection mirror and the like. In the exposure unit 1, optical elements such as a polygon mirror for scanning laser beam, and a lens and mirrors for guiding the laser beam reflected by the polygon mirror to the photoreceptor drums 3 are arranged. Moreover, as the exposure unit 1, for example, a method of using an EL or LED write head having light emitting elements arranged in an array is also able to be employed instead.

The exposure unit 1 has a function of forming, by exposing the charged photoreceptor drum 3 in accordance with input image data, an electrostatic latent image in accordance with the image data on a surface thereof. The developing device 2 visualizes the electrostatic latent image formed on each of the photoreceptor drums 3 by four color (Y, M, C, and K) toners. In addition, the cleaner unit 4 removes and collects the toner remaining on the surface of the photoreceptor drum 3 after development and image transfer.

The intermediate transfer belt unit 6 arranged above the photoreceptor drums 3 is provided with an intermediate transfer belt 61, an intermediate transfer belt driving roller 62, an intermediate transfer belt driven roller 63, an intermediate transfer rollers 64 and an intermediate transfer belt cleaning unit 65. Four intermediate transfer rollers 64 are provided corresponding to the respective colors of Y, M, C and K.

The intermediated transfer belt driving roller 62, the intermediate transfer belt driven roller 63, and the intermediate transfer roller 64 cause the intermediate transfer belt 61 to be driven to rotate in a tensioned state. In addition, each of the intermediate transfer rollers 64 applies a transfer bias for transferring the toner image on the photoreceptor drum 3 onto the intermediate transfer belt 61.

The intermediate transfer belt 61 is provided to be in contact with each of the photoreceptor drums 3, and transfers the toner images of the respective colors which are formed on the photoreceptor drums 3 sequentially to the intermediate transfer belt 61 so as to be superimposed on each other to thereby form a color toner image (multicolor toner image) on the intermediate transfer belt 61. The intermediate transfer belt 61 is formed endlessly from a film whose thickness is, for example, about from 100 μm to 150 μm.

The toner images are transferred from the photoreceptor drums 3 to the intermediate transfer belt 61 by the intermediate transfer rollers 64 that are in contact with a back side of the intermediate transfer belt 61. A high voltage transfer bias (a high voltage that has a polarity (+) reverse to the charge polarity (−) of the toner) is applied to the intermediate transfer rollers 64 to transfer the toner images. Each of the intermediate transfer rollers 64 is a roller formed on the basis of a metal (for example, stainless steel) shaft whose diameter is from 8 to 10 mm, with a surface thereof covered with an electrically conductive elastic material (for example, EPDM, foam polyurethane and the like). This electrically conductive elastic material makes it possible to apply the high voltage uniformly to the intermediate transfer belt 61. Though roller type transfer electrodes are used in the present exemplary configuration, brush type transfer electrodes are also usable instead.

The electrostatic images visualized on each of the photoreceptor drums 3 corresponding to respective color hues as described above are stacked on the intermediate transfer belt 61. The electrostatic images thus stacked are transferred by rotation of the intermediate transfer belt 61, to a recording paper by a transfer roller 10 described below, which is a secondary transfer mechanism portion arranged at a position where the paper makes contact with the intermediate transfer belt 61. As the secondary transfer mechanism portion, not only the transfer roller but also a corona charger or a transfer belt is usable.

In this case, the intermediate transfer belt 61 and the transfer roller 10 are in pressure contact with a predetermined nip, as well as a voltage (high voltage that has a polarity (+) reverse to the charge polarity (−) of the toner) is applied to the transfer roller 10 to transfer the toner to the paper. Further, in order for the transfer roller 10 to constantly obtain the above nip, one of the transfer roller 10 and the intermediate transfer belt driving roller 62 is made of a solid material (such as metal) and the other is made of a soft material such as an elastic roller (such as an elastic rubber roller or a foam resin roller).

Moreover, as described above, the toner that adheres to the intermediate transfer belt 61 due to the contact with the photoreceptor drums 3, or the toner remaining on the intermediate transfer belt 61 because transfer to the recording paper is not performed by the transfer roller 10 causes colors of the toner to be mixed in the next process, and therefore is set to be removed and collected by the intermediate transfer belt cleaning unit 65. The intermediate transfer belt cleaning unit 65 is provided with, for example, a cleaning blade as a cleaning member that is in contact with the intermediate transfer belt 61, and a part of the intermediate transfer belt 61 in contact with the cleaning blade is supported from the back side by the intermediate transfer belt driven roller 63.

The intermediate transfer belt unit 6 and the transfer roller 10 described above constitute the transfer portion 113 of FIG. 1. A driving mechanism portion (not-shown) for causing the photoreceptor drums 3 and the intermediate transfer belt 61 to be in contact with or separated from each other is provided. A configuration and an operation of this driving mechanism portion will be described below.

The paper feed cassette 81 is a tray for storing sheets of recording paper (sheets) used for image formation, and is provided below the exposure unit 1 of the main apparatus body 130. Further, a recording paper used for image formation is also able to be placed on a manual paper feed cassette 82. The paper output tray 91 provided in an upper portion of the main apparatus body 130 is a tray for laying the printed recording paper facedown.

Further, in the main apparatus body 130, a paper conveyance path S1 having a substantially vertical shape is provided for carrying recording papers on the paper feed cassette 81 and the manual paper feed cassette 82 to the paper output tray 91 via the transfer roller 10 and the fixing unit 7. Disposed in the vicinity of the paper conveyance path S1 between the paper feed cassette 81 or the manual paper feed cassette 82 and the paper output tray 91 are pickup rollers 11*a* and 11*b*, a plurality of conveyance rollers 12*a* to 12*d*, a resist roller 13, the transfer roller 10, the fixing unit 7 and the like.

The plurality of conveyance rollers 12*a* to 12*d* are small rollers for facilitating and assisting conveyance of the recording paper, and are provided along the paper conveyance path S1. In addition, the pickup roller 11*a* is provided in the vicinity of an end of the paper feed cassette 81, and picks up recording papers one by one from the paper feed cassette 81 to supply to the paper conveyance path S1. Similarly, the pickup roller 11*b* is provided in the vicinity of an end of the manual paper feed cassette 82, and picks up recording papers one by one from the manual paper feed cassette 82 to supply to the paper conveyance path S1.

Further, the resist roller 13 temporarily keeps a recording paper conveyed along the paper conveyance path S1. In addition, the resist roller 13 has a function of conveying the recording paper to the transfer roller 10 at such timing that a leading end of the toner image on the photoreceptor drum 3 meets a leading end of the recording paper.

The fixing unit 7 corresponds to the fixing portion 114 of FIG. 1 and is provided with a heat roller 71 and a pressure roller 72. The heat roller 71 and the pressure roller 72 rotate sandwiching a recording paper. Moreover, the heat roller 71 is set so as to have a predetermined fixing temperature by control means based on a signal from a not-shown temperature detector, and has a function of heating and compressing the toner to the recording paper together with the pressure roller 72, thereby fusing, mixing and compressing the multicolor toner image which is transferred to the recording paper to thermally fix to the recording paper.

In the fixing unit 7, fixing processing of the toner image is performed as described above, as well as recording paper smoothing processing is performed by passing a recording paper through the fixing unit 7 without transferring the toner image. In the smoothing processing, pressure force by the heat roller 71 and the pressure roller 72 of the fixing unit 7 is able to be set variably. Further, the number of times to pass through the fixing unit 7 to pass through the fixing unit 7 again using the duplex conveyance path S2 is able to be set variably. A pressure mechanism by the pressure roller 72 to the heat roller 71 will be omitted in FIG. 2 and a specific exemplary configuration thereof will be described below.

Next, the conveyance path of a recording paper will be described more specifically. As described above, the image forming apparatus 100 is provided with the paper feed cassette 81 in which recording papers are stored in advance and the manual paper feed cassette 82. Each of the pickup rollers 11*a* and 11*b* is arranged to feed recording papers from these paper feed cassettes 81 and 82, so as to guide the recording papers one by one to the paper conveyance path S1.

A recording paper conveyed from each of the paper feed cassettes 81 and 82 is conveyed to the resist roller 13 by the conveyance roller 12*a* along the paper conveyance path S1, and is conveyed to the transfer roller 10 at such timing that a leading end of the recording paper meets a leading end of image information on the intermediate transfer belt 61, thus, the toner image is transferred onto the recording paper. Subsequently, the recording paper passes through the fixing unit 7 in which an unfixed toner on the recording paper is fused and fixed by heat and then ejected onto the paper output tray 91 via the conveyance roller 12*b* disposed downstream.

The above conveyance path is for a case where one-side printing is requested for a recording paper, while in a case where duplex printing is requested, when one-side printing is finished as described above and a rear end of the recording paper passing through the fixing unit 7 is held by the final conveyance roller 12*b*, the conveyance roller 12*b* rotates in a reverse direction so that the recording paper is guided to the conveyance path S2 along which the conveyance rollers 12*c* and 12*d* are disposed. Then, the conveyance path S2 reaches at the paper conveyance path S1 and the recording paper is conveyed from the resist roller 13 to the transfer roller 10. At this time, since a front side and a backside of the recording paper are inverted at a stage of reaching at the paper conveyance path S1 from the path S2, the back side of the recording paper is printed at the transfer roller 10. The recording paper whose back side has been printed is then fixed by the fixing unit 7 and ejected to the paper output tray 91.

The above conveyance path S2 used for duplex printing is used when printing is performed for a recording paper whose surface is rough such as an embossed paper or a recording paper with a folding line.

In this case, the recording paper fed from the paper feed cassettes 81 and 82 is carried to the fixing unit 7 without performing image formation at the intermediate transfer belt unit 6 and the transfer portion of the transfer roller 10, and heated and compressed at the fixing unit 7 for smoothing processing.

Then, using the duplex printing conveyance path S2, the recording paper subjected to the smoothing processing is conveyed again from the conveyance path S1 to the transfer portion. Here, a toner image of target image data is transferred to the recording paper at the transfer portion. Since the recording paper has been already smoothed by the fixing unit 7, it is possible to perform the transfer from the intermediate transfer belt 61 reliably. The toner image transferred to the recording paper is then fixed by the fixing unit 7 and thereafter ejected. Further, at this time, when duplex printing is performed, it is possible that the recording paper is conveyed again to the duplex printing conveyance path S2 and image formation is performed on a side opposite to the side on which image formation has been performed at first.

Moreover, the above smoothing processing is able to be performed plural times as appropriate in accordance with thickness of a paper, difference of a degree of embossing or the like. Here, it is possible to set the number of times to execute the smoothing processing in accordance with a user operation. In this case, after the smoothing processing is performed by heating and compressing the recording paper by the fixing unit 7, using the duplex printing conveyance path S2, the recording paper is carried again to the fixing unit 7 without transferring the toner image for performing heating and compressing processing. It is possible to further execute this operation plural times in accordance with user setting. In addition, when the smoothing processing is performed, it is possible to set pressure force in the fixing unit 7 in accordance with user setting.

Then, after finishing the predetermined number of times of the smoothing processing, using the duplex printing conveyance path S2 again, the toner image formed on the intermediate transfer belt 61 is transferred to perform image formation. Such processing allows the user to execute the processing for improving smoothness in an optimum state in accordance with surface roughness of an embossed paper or a paper with a folding line or thickness of a paper.

As described above, in the embodiment of the image forming apparatus according to the present invention, when image formation is performed using a recording paper whose surface roughness is rough or a recording paper with a folding line, before performing transfer and fixing of a toner image to the recording paper, the smoothing processing is performed by pressing the recording paper while heating using the fixing unit 7. This makes it possible to smooth a recording paper whose surface is rough or a recording paper with a folding line, and to obtain a high-quality transfer image by causing the recording paper to be in contact with the intermediate transfer belt 61 reliably.

At this time, the number of times to perform the smoothing processing by the fixing unit 7 and pressure force in the fixing unit 7 are able to be set variably, so that it becomes possible to perform the smoothing processing under the optimum condition in accordance with surface roughness and thickness of the recording paper and to perform high-quality image formation without image deterioration by transferring the image formed on the intermediate transfer belt 61 to the recording paper reliably and stably. Further, moisture of the recording paper is extracted by heating to increase resistance of the recording paper, so that an effect of improving transfer property of a toner is also able to be obtained.

In order to perform the above operation, the image forming apparatus is configured to be able to take any of (A) a color image formation mode, (B) a monochrome image formation mode, and (C) a non-image formation mode in the embodiment according to the present invention. When the recording paper is heated and pressed as the smoothing processing without performing image formation, the above (C) non-image formation mode is taken. In the non-image formation mode, a travelling position of the intermediate transfer belt 61 is moved so that the intermediate transfer belt 61 is separated from all the photoreceptor drums 3. Thereby, the remaining toner that exists on the photoreceptor drums 3 (so-called blurred toner) is prevented from being adhered to the recording paper.

Further, in the color image formation mode, it is controlled so that the intermediate transfer belt 61 is in contact with all the photoreceptor drums 3 for Y, M, C and K. In addition, in the monochrome image formation mode, it is controlled so that the intermediate transfer belt 61 is in contact with only the photoreceptor drum 3 for K. In this manner, it is controlled so that the intermediate transfer belt 61 is in contact with only the photoreceptor drum 3 used for image formation depending on for color or monochrome.

The configuration for switching each of the above modes will be described. The following configuration specifically shows a configuration of the driving mechanism portion of the present invention.

Figure 3:
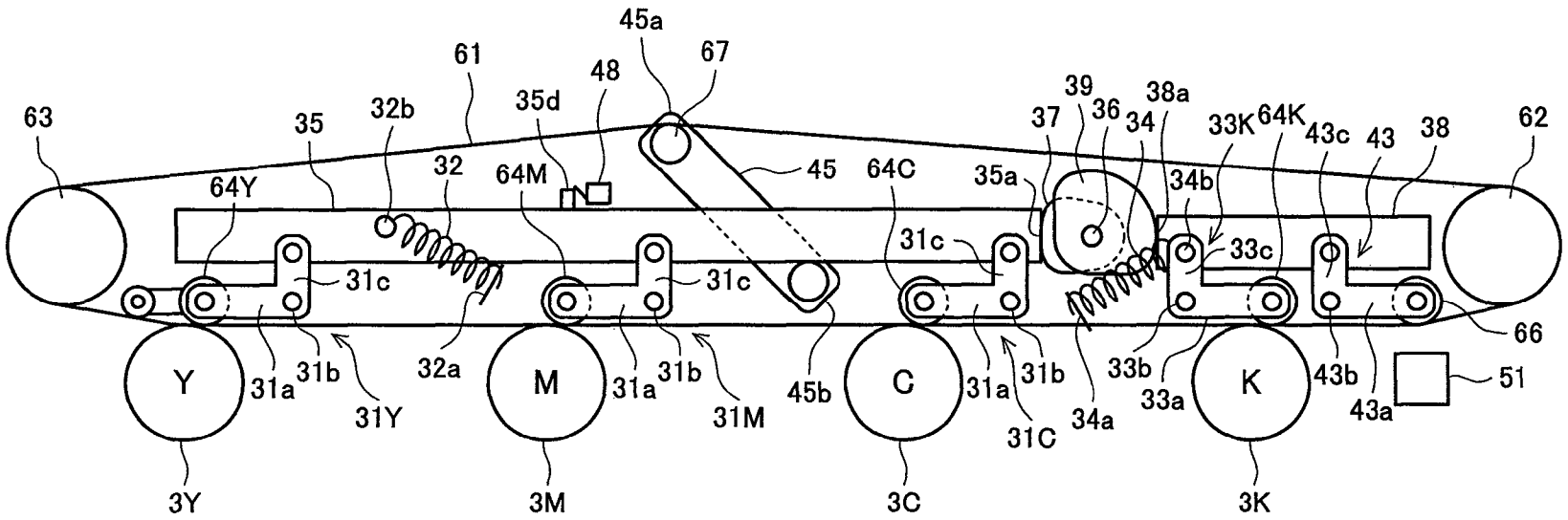
FIG. 3 is a view describing a configuration and an operation of a driving mechanism portion of an intermediate transfer belt for photoreceptor drums.
Figure 4:
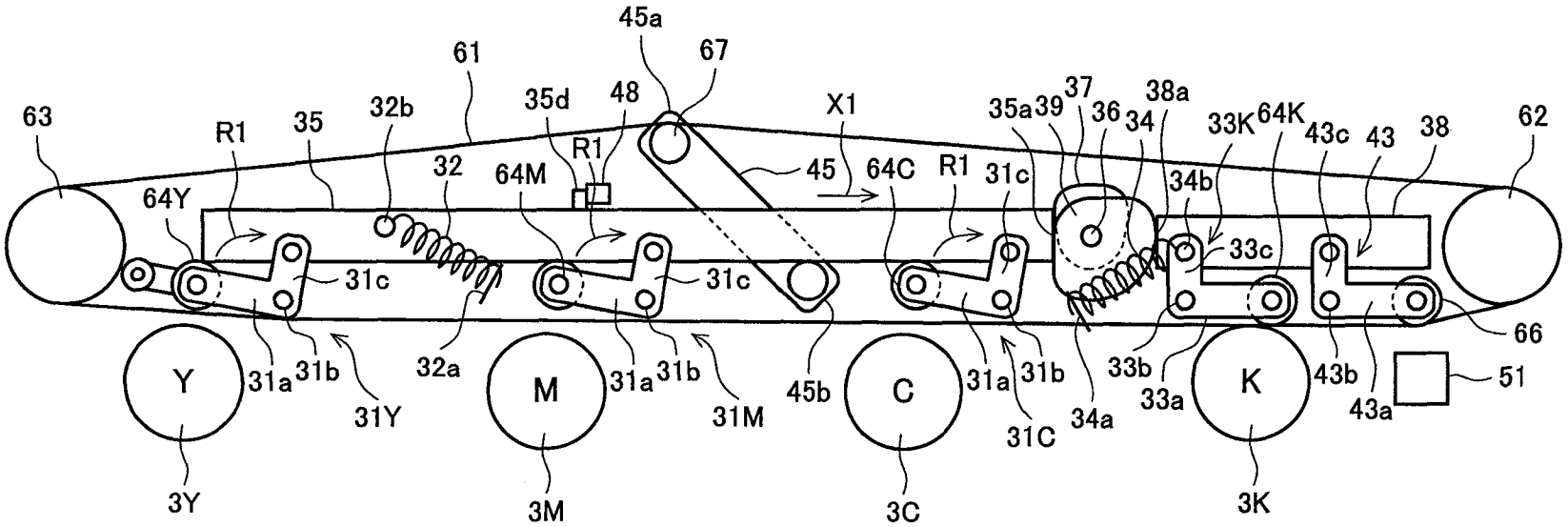
FIG. 4 is another view describing a configuration and an operation of the driving mechanism portion of the intermediate transfer belt for the photoreceptor drums.
Figure 5:
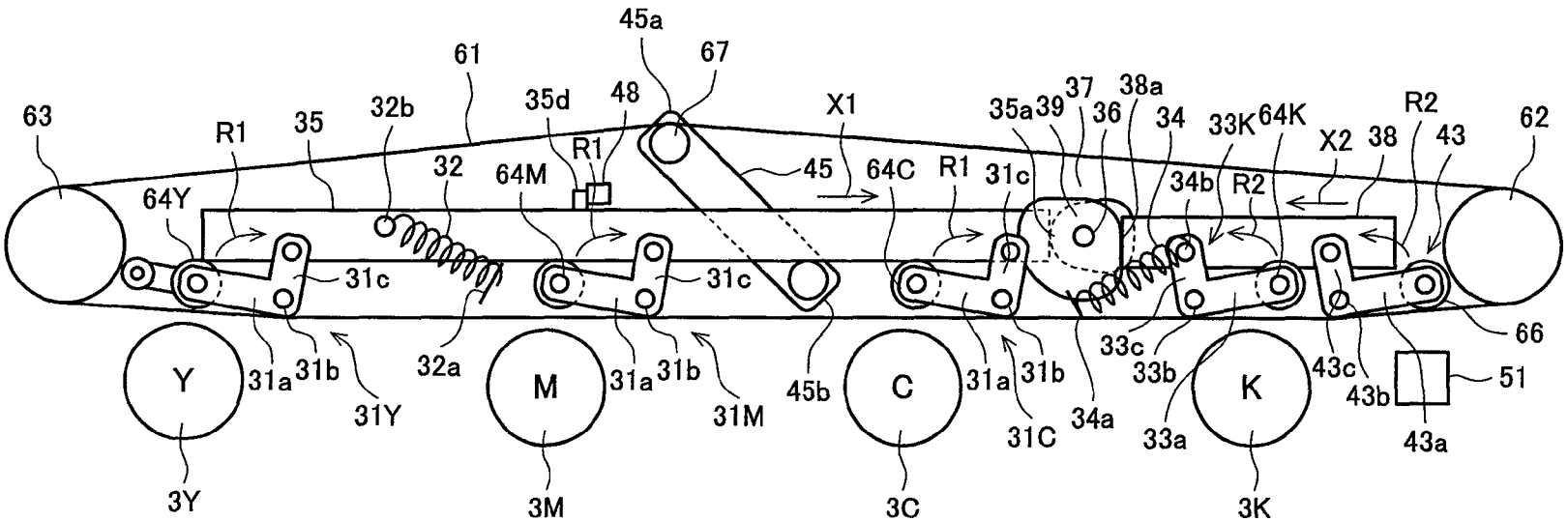
FIG. 5 is still another view describing a configuration and an operation of the driving mechanism portion of the intermediate transfer belt for the photoreceptor drums.

FIGS. 3 to 5 are views describing a configuration and an operation of the driving mechanism portion of the intermediate transfer belt for the photoreceptor drums. Note that, in the following description and each figure, when it is necessary to distinguish the photoreceptor drums 3 and the intermediate transfer rollers 64 corresponding to the respective colors of Y, M, C and K, Y, M, C or K showing each color is attached at an end of the numerals of each of the photoreceptor drums 3 and each of the intermediate transfer rollers 64 for distinguishing.

FIG. 3 is a view showing a state of the color image formation mode in which image formation is performed using all the photoreceptor drums. Each of the intermediate transfer rollers 64Y, 64M and 64C arranged facing each of the photoreceptor drums 3Y, 3M and 3C for Y, M and C is supported rotatably by a leading end of one arm bracket (hereinafter, referred to as a "lateral arm bracket") 31*a* of a transfer roller arm 31 formed in a substantially L shape.

In the transfer roller arm 31, an L-shaped bending portion 31*b* is supported and fixed rotatably by a not-shown apparatus frame, and a leading end of the other arm bracket (hereinafter, referred to as a "vertical arm bracket") 31*c* of the transfer roller arm 31 is supported rotatably by a first slide bracket 35. The first slide bracket 35 is arranged so as to be able to reciprocate in the horizontal direction.

In the first slide bracket 35, a right-side end 35*a* of FIG. 3 is brought into abutting contact with a cam surface of a first eccentric cam 37 that is held rotatably by a cam shaft 36 to the not-shown apparatus frame. Further, a first spring 32 having one end 32*a* locked and fixed to the not-shown apparatus frame and the other end 32*b* locked and fixed to the first slide bracket 35 biases the right-side end 35*a* of the first slide bracket 35 into constantly pressure contact with the cam surface of the first eccentric cam 37.

Meanwhile, the intermediate transfer roller 64K arranged facing the photoreceptor drum 3K is supported rotatably by a leading end of one arm bracket (hereinafter, referred to as a "lateral arm bracket") 33*a* of a transfer roller arm 33 formed in a substantially L shape. In the transfer roller arm 33, an L-shaped bending portion 33*b* is supported and fixed rotatably by the not-shown apparatus frame, and a leading end of the other arm bracket (hereinafter, referred to as a "vertical arm bracket") 33*c* of the transfer roller arm 33 is supported rotatably by a second slide bracket 38 that is arranged so as to be able to reciprocate in the horizontal direction.

A backup roller 66 is supported rotatably by a leading end of one arm bracket (hereinafter, referred to as a "lateral arm bracket") 43*a* of a backup roller arm 43 formed in a substantially L shape. In the backup roller arm 43, an L-shaped bending portion 43*b* is supported and fixed rotatably by the not-shown apparatus frame, and a leading end of the other arm bracket (hereinafter, referred to as a "vertical arm bracket") 43*c* of the backup roller arm 43 is supported rotatably by the second slide bracket 38.

In the second slide bracket 38, a left-side end 38*a* of FIG. 3 is brought into abutting contact with a cam surface of a second eccentric cam 39 that is held rotatably by the camshaft 36 to the not-shown apparatus frame. Further, in the second slide bracket 38, a second spring 34 having one end 34*a* locked and fixed to the not-shown apparatus frame and the other end 34*b* locked and fixed to the second slide bracket 38 biases the left-side end 38*a* of the second slide bracket 38 into constantly pressure contact with the cam surface of the second eccentric cam 39.

In addition, an optical sensor 51 is arranged at a position facing the backup roller 66 via the intermediate transfer belt 61. The backup roller 66 is provided in front of the optical sensor 51 and is able to detect reflection light (density) of a reference toner correctly by flattening the intermediate transfer belt 61.

A tension roller 67 for giving predetermined tension force to the intermediate transfer belt 61 is supported rotatably by a leading end 45*a* of a tension roller arm 45. A lower end 45*b* of the tension roller arm 45 is supported rotatably by the not-shown apparatus frame. Note that, though not shown, the tension roller arm 45 is biased to give predetermined tension force constantly to the intermediate transfer belt 61 by biasing means such as a coil spring.

Further, the first slide bracket 35 is provided with a projection portion 35*d*, and in the vicinity of the projection portion 35*d*, a detection switch 48 is arranged being installed and fixed to the not-shown apparatus frame. The detection switch 48 detects whether or not the first slide bracket 35 slides.

In the arrangement configuration as described above, each lateral arm bracket 31*a* of the transfer roller arms 31Y, 31M and 31C each corresponding to Y, M and C, the lateral arm bracket 33*a* of the transfer roller arm 33K corresponding to K, and the lateral arm bracket 43*a* of the backup roller arm 43 are arranged in a state of being directed in the opposite direction to each other.

Rotational control of the first eccentric cam 37 and the second eccentric cam 39 makes it possible to move the first slide bracket 35 from the position shown in FIG. 3 to a right direction X1 as shown in FIG. 4. At this time, each of the transfer roller arms 31Y, 31M and 31C rotates about a rotational fulcrum of each of the bending portions 31*b* in a right direction R1 and each of the lateral arm brackets 31*a* moves upward so that each of the intermediate transfer rollers 64Y, 64M and 64C is separated from the intermediate transfer belt 61. As a result, the intermediate transfer belt 61 is separated from each of the photoreceptor drums 3Y, 3M and 3C. At this time, the detection switch 48 is turned from the OFF state shown in FIG. 3 to the ON state shown in FIG. 4. FIG. 4 shows a state of the monochrome image formation mode in which image formation is performed only by the photoreceptor drum 3K for K.

Meanwhile, when the second slide bracket 38 moves from the position shown in FIG. 4 to a left direction X2 as shown in FIG. 5 with rotational control of the first eccentric cam 37 and the second eccentric cam 39, the transfer roller arm 33K and the backup roller arm 43 rotate about a rotational fulcrum of each of the bending portions 33*b* and 43*b* in a left direction R2. At this time, each of the lateral arm brackets 33*a* and 43*a* moves upward so that the intermediate transfer roller 64K and the backup roller 66 are separated from the intermediate transfer belt 61, resulting that the intermediate transfer belt 61 is separated from the photoreceptor drum 3K and the optical sensor 51.

This state provides the non-image formation mode in which the intermediate transfer belt is separated from all the photoreceptor drums 3Y, 3M, 3C and 3K. The image forming apparatus moves to the state of this non-image formation mode when the smoothing processing is performed for a recording paper whose surface is rough or a recording paper with a folding line.

In the above configuration, the not-shown control portion of the image forming apparatus controls to change the state of the intermediate transfer belt 61, for example, to the color image formation mode, the monochrome image formation mode or the non-image formation mode. The mode change is able to be executed, for example, based on the mode condition that is set based on a user operation for the operation panel. Moreover, when image data is input from an external device such as a PC (personal computer) or a recording medium, if the image data includes information instructing a mode, the mode change is performed in accordance with the information. For example, when image data includes information instructing the recording paper smoothing processing, the control portion of the image forming apparatus moves to the non-image formation mode and performs the recording paper smoothing processing.

Further, the above control portion judges each of these modes above based on output from the optical sensor 51 and a detection signal from the detection switch 48. For example, when the detection switch 48 is OFF and the optical sensor 51 is ON (with reflection light), it is judged as the color image formation mode in the state shown in FIG. 3, when the detection switch 48 is ON and the optical sensor 51 is ON (with reflection light), it is judged as the monochrome image formation mode in the state shown in FIG. 4, and when the detection switch 48 is ON and the optical sensor 51 is OFF (no reflection light), it is judged as the non-image formation mode in the state shown in FIG. 5. The control portion is connected with an eccentric cam driving source (motor), and detects which state the intermediate transfer belt 61 has and controls the eccentric cam driving source, and is therefore able to control rotation of the first eccentric cam 37 and the second eccentric cam 39 to set to each operation mode.

Next, a pressure adjustment mechanism of the fixing unit 7 will be described.

In the downstream side of the conveyance direction of a recording paper of the intermediate transfer belt unit 6 and the transfer roller 10, the fixing unit 7 for fixing a toner image transferred onto a recording paper by heating is provided.

Figure 6:
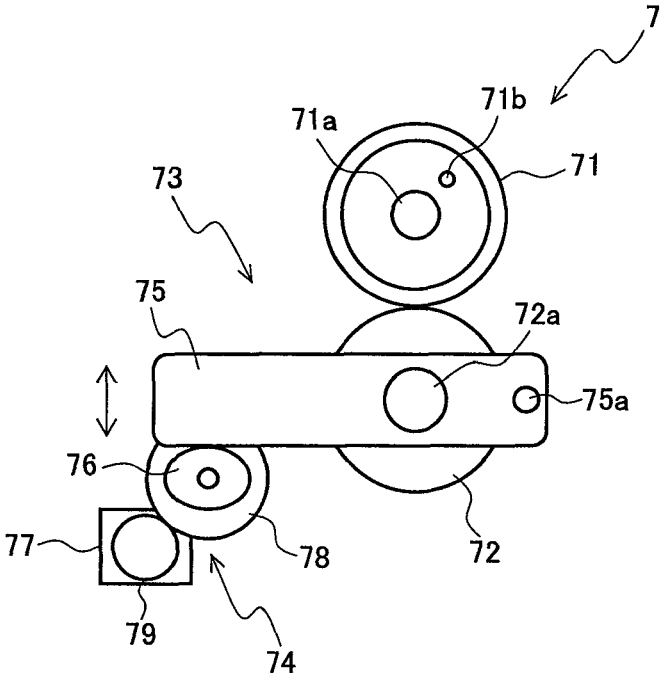
FIG. 6 is a view for describing a pressure adjustment mechanism of a fixing unit of the image forming apparatus according to the present invention.

FIG. 6 is a schematic structural view of the fixing unit 7 having a pressure adjusting portion in a side view. The fixing unit 7 is provided with the heat roller (fixing roller) 71 as a fixing member, the pressure roller 72 as a pressure member, and a pressure adjusting portion 73 for adjusting pressure of the heat roller 71 and the pressure roller 72.

The heat roller 71 is embedded with a heater 71*a* inside so as to be able to heat a fixing temperature to a predetermined fixing temperature. The fixing temperature is able to be set at 180 to 190 degrees, for example, when plain paper is used, and at 200 to 210 degrees, for example, when fixing is performed for index paper such as an OHP paper. Accordingly, the heater 71*a* embedded in the heat roller 71 is able to control the fixing temperature by switching in multilevel. The temperature of the heat roller 71 is detected by a fixing temperature sensor 71*b*, and temperature control of the heater 71*a* and driving control of the paper conveyance path are performed based on a signal from the fixing temperature sensor 71*b*.

The pressure roller 72 is provided facing the heat roller 71 and pressure force to the heat roller 71 is adjusted by the pressure adjusting portion 73. The pressure adjusting portion 73 is provided with an adjusting lever 75 for supporting the pressure roller 72 so as to swing freely and a driving portion 74 for driving the adjusting lever 75 so as to swing freely. The adjusting lever 75 supports a roller shaft 72*a* of the pressure roller 72 at a center part thereof and swings freely about a fulcrum 75*a* formed at one end side of the adjusting lever 75.

The driving portion 74 is configured by an elliptic eccentric cam 76 that rotates being brought into abutting contact with a lower surface of the other end of the adjusting lever 75, a driving motor 77 for driving the eccentric cam 76 to rotate, and gears 78 and 79 for transmitting driving force of the driving motor 77 to the eccentric cam 76. The gear 78 is supported in coaxial with the eccentric cam 76 to be engaged with the gear 79 fixed to a shaft of the driving motor 77. The eccentric cam 76 adjusts pressure force of the pressure roller 72 to the heat roller 71. The adjustment of the pressure force is in accordance with a user setting value.

In the pressure adjustment operation of the fixing unit 7, by rotating the driving motor 77, the eccentric cam 76 rotates so that the adjusting lever 75 in abutting contact with the eccentric cam 76 swings about the fulcrum 75*a* at an end thereof. Since the adjusting lever 75 also serves as a bearing of the shaft 72*a*, by controlling the driving motor 77, contact pressure force of the pressure roller 72 to the heat roller 71 is able to be set variably.

For example, in the case of a paper whose surface roughness is rough, the user sets high pressure force so as to be able to perform the smoothing processing more efficiently. Further, at this time, in the case of a card board, it is possible to set higher pressure force than the pressure for plain paper. Using setting of pressure force and setting of the number of times of the smoothing processing in combination, the user is able to set the condition of the smoothing processing in accordance with the state of a recording paper as appropriate. This makes it possible to perform the smoothing processing with pressure force that is set as appropriate in accordance with thickness or surface roughness of a recording paper with pressure force of the fixing unit 7 optimized.

Figure 8:
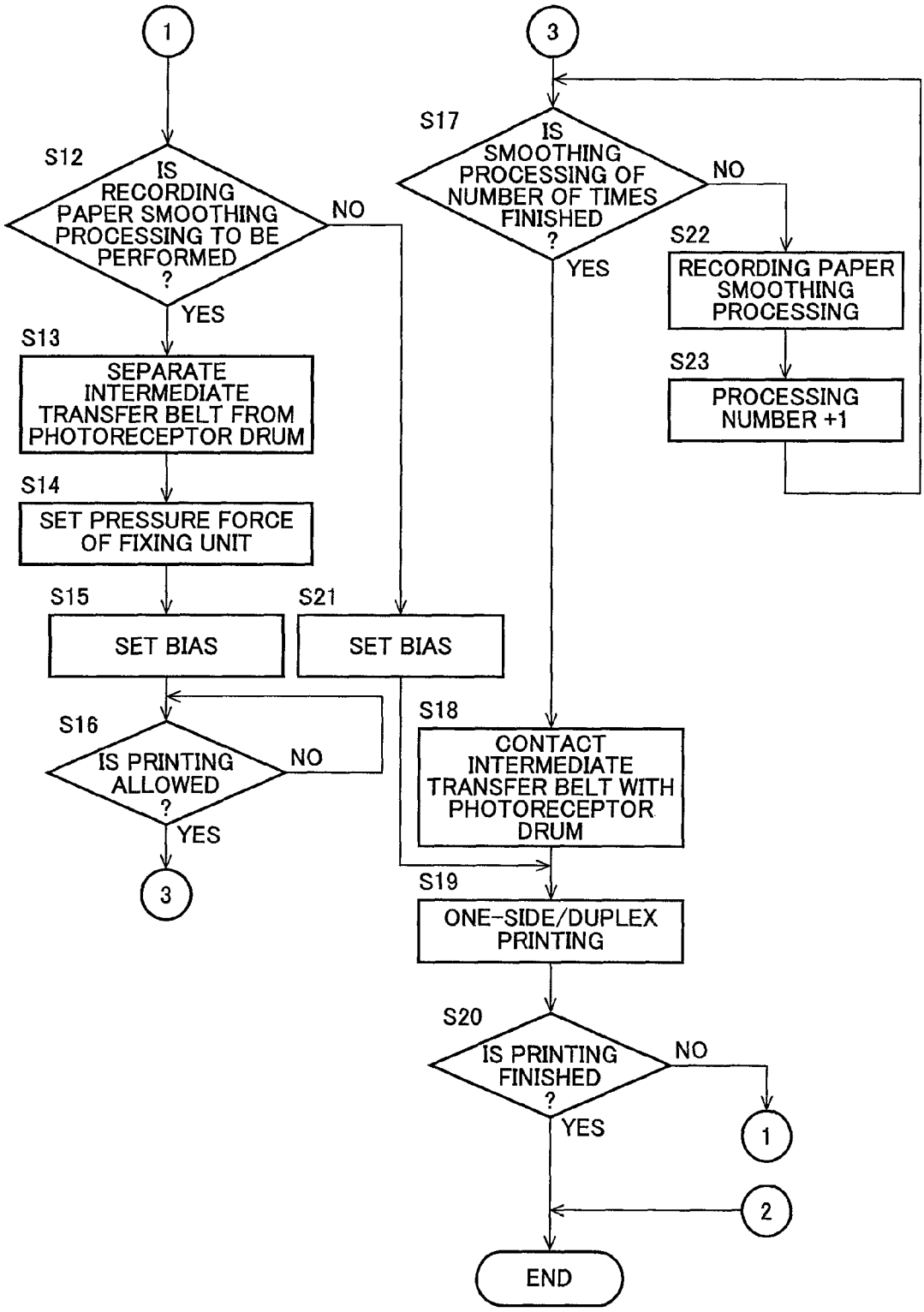
FIG. 8 is a flowchart for describing exemplary image formation processing in the image forming apparatus according to the present invention, and is a view subsequent to FIG. 7.

FIG. 7 and FIG. 8 are flowcharts for describing exemplary image formation processing in the image forming apparatus according to the present invention. As the image forming apparatus, the multi-functional peripheral as shown in FIG. 2 is applicable. In this case, as image data subjected to image formation in the image forming apparatus, image data read by image reading means of the multi-functional peripheral, image data input from an external device such as a PC, or the like is usable. In the following example, description will be given for exemplary processing when image data edited by an external PC is subjected to image formation (printing) by the image forming apparatus.

First, an application for image edit is operated in the external PC, and edit of image data for printing (image formation) is performed by a user (step 31). When the edit is finished (step S2—Yes), the user judges whether or not to cause the image forming apparatus to print the edited image (step S3). In the case of not printing, the edited image data is saved in the PC and the application for image edit is closed to finish the processing.

In the case of performing printing at step S3, the user operates the PC to perform printing setting (setting of the condition of image formation) (step S4). In the printing setting, for example, general printing setting, such as setting of a recording paper size, one-side printing, duplex printing or a margin, is performed.

When a recording paper is a recording paper whose surface is rough, for example, such as an embossed paper or a recording paper with a folding line such as an invitation, then setting to execute the smoothing processing of the recording paper is performed (step S5). Then, pressure force in executing the smoothing processing is set (step S6), and the number of times of the smoothing processing is set (step S7). Here, the pressure force of the smoothing processing refers to pressure force by the heat roller 71 and the pressure roller 72 of the fixing unit 7, and the number of times of the smoothing processing refers to the number of times to pass the recording paper through the fixing unit 7.

Subsequently, whether the number of times of the smoothing processing is an odd number is judged (step S8). In the case of passing through the fixing unit 7 plural times, after performing the smoothing processing by heating and compressing the recording paper by the fixing unit 7, the recording paper is carried to the fixing unit 7 again using the duplex printing conveyance path S2. At this time, a front side and a back side of the recording paper are inverted. After passing through the fixing unit 7 odd number of times, when a toner is then transferred to perform image formation, the recording paper is in the state that a front side and a back side thereof are inverted from the initial state.

When the number of times of the smoothing processing that is set is the odd number of times at step S8, whether or not the recording paper is to specify a side is judged (step S9). The recording paper to specify a side refers to, for example, a recording paper that is a recording paper one side of which has been printed and needs to newly perform image formation on the side opposite to the printed side, or a recording paper that is a recording paper with a folding line and has a side to be specified for image formation between the front side and the back side of the folding line.

Further, in judging whether or not to be a recording paper to specify a side, for example, it may be configured such that when setting the smoothing processing, the user is requested to set whether or not to be a recording paper to specify a side, or when the number of times of the smoothing processing is set to be the odd number of times, the user is requested to set whether or not to be a paper to specify a side.

When the recording paper is a paper to specify a side, the user is alarmed that a front side and a back side of the recording paper are inverted (step S10). As the alarm, the alarm may be given, for example, by causing the display portion 116 to display that effect, or the alarm may be given by sound by providing sound output means. Further, the alarm that a front side and a back side the recording paper are inverted may be executed when the number of times of the smoothing processing is the odd number of times, whether or not the recording paper is a paper to specify a side.

In a case where the alarm is given at step S10, when the number of times of the smoothing processing set at step S8 is not the odd number of times or when the recording paper is not to specify a side at step S9, the image forming apparatus judges whether printing is to be executed in accordance with a user operation (step S11). For example, at the time when the alarm is given, the user is able to execute printing after performing an operation of changing the number of times of the smoothing processing or the like. Here, when the user operates the PC to execute printing, the edited image data is transmitted for image formation as printing data.

The image forming apparatus receiving the image data confirms whether or not the recording paper smoothing processing set by the user is to be executed (step S12). When the recording paper smoothing processing is to be executed, the image forming apparatus moves to the non-image formation mode to separate the intermediate transfer belt 61 from all the photoreceptor drums 3 (step S13). Thereby, the remaining toner on the surfaces of the photoreceptor drums is prevented from being adhered to the recording paper. The image forming apparatus then sets pressure force of the fixing unit in accordance with user setting.

Subsequently, the image forming apparatus sets a charging bias of the photoreceptor drums, a charging bias of the intermediate transfer belt, and a charging bias to the transfer roller (step S15).

When performing the smoothing processing, the recording paper is passed through the transfer roller 10 without transferring the toner image thereto and carried to the fixing unit 7. At this time, bias application is performed as follows so that the toner is not adhered to the recording paper.

For example, when a toner with the minus polarity is used, the photoreceptor drums 3 are separated from the intermediate transfer belt 61, and therefore a cleaning bias is applied or a bias is not applied. By applying a weak plus bias of about a few hundred volts (+100 to +200) to the intermediate transfer belt 61, it is possible to draw the toner with the minus polarity remaining on the intermediate transfer belt 61. This makes it possible to prevent the remaining toner from being adhered to the recording paper.

Further, by applying a weak minus bias of about a few hundred volts (−100 to −200) to the transfer roller 10, the toner with the minus polarity is rebelled, thus making it possible to pass through a nip portion between the transfer roller 10 and the intermediate transfer belt 61 without adhering the toner to the recording paper.

When pre-processing necessary for printing, such as setting and application of biases is performed at step S15, the image forming apparatus confirms whether or not all pre-processing such as setting of temperature of the fixing unit 7 is competed and printing is allowed (step S16).

When printing is allowed, whether or not the smoothing processing of the number of times that is set is finished (step S17), and when not finished, the recording paper smoothing processing is performed (step S22). Here, without writing the image data to the photoreceptor drums 3 by the exposure unit 1, the recording paper is fed and passed through the nip portion between the transfer roller 10 and the intermediate transfer belt 61 to reach the fixing unit 7.

In the fixing unit 7, the recording paper is heated and pressed by the heat roller 71 and the pressure roller 72 to perform the smoothing processing such as erasing a trace of a folding line or decreasing surface roughness. In this case, by adjusting pressure force of the heat roller 71 and the pressure roller 72 to the recording paper in accordance with setting of smoothing pressure in the smoothing processing, it is possible to perform smoothing of the recording paper more effectively. This makes it possible to adjust the condition of heating and compressing processing for the recording paper in accordance with the recording paper.

When the smoothing processing is performed by passing the recording paper through the fixing unit 7, the number of times of processing is incremented by 1 (number of times of processing+1) (step S23). Then, after returning to step S17, when the number of times of the smoothing processing does not reach the set number of times, the smoothing processing of step S22 is repeated. Alternatively, when the smoothing processing of the set number of times is finished at step S17, printing processing of the image data is performed. Here, the intermediate transfer belt 61 separated from the photoreceptor drum 3 is firstly caused to contact with the photoreceptor drum 3 again (step S18). Here, depending on the color image formation mode or the monochrome image formation mode, the intermediate transfer belt 61 is caused to contact with the required photoreceptor drum 3.

Then, in accordance with printing setting, one-side printing or duplex printing is performed for the recording paper (step S19). Here, at the time when a rear end of the recording paper passing through the fixing unit 7 by the smoothing processing of step S22 reaches the conveyance roller 12*b* disposed downstream from the fixing unit 7, the conveyance roller 12*b* is reversed. Thereby, with switchback that a front side and a back side of the recording paper are inverted, the recording paper is conveyed to the duplex conveyance path S2 along which the conveyance rollers 12*c* and 12*d* are arranged. Then, the recording paper is carried again between the transfer roller 10 and the intermediate transfer belt 61 from the resist roller 13. In the image forming apparatus 100, while the recording paper is conveyed in the duplex conveyance path S2 after the smoothing processing is finished, an operation for contacting the intermediate transfer belt 61 with the photoreceptor drum 3 is performed. Then, when the recording paper conveyed in the duplex conveyance path S2 passes between the transfer roller 10 and the intermediate transfer belt 61 again, transfer of the toner image onto the recording paper is performed.

Further, in the above processing, when the recording paper to be smoothed has a folding line, by conveying the recording paper so that the outward of the folding line of the recording paper is bought into abutting contact with the side of the heat roller 71 of the fixing unit 7, it is possible to smooth the folding line more effectively. In this case, the user makes the recording paper with a folding line in the opened state and places it on the manual paper feed cassette 82. At this time, the recording paper is placed so that the outward of the folding line of the recording paper faces downward and the inward of the folding line faces upward. Thereby, the outward of the recording paper conveyed to the fixing unit 7 is in contact with the heat roller 71 and the folding line is smoothed effectively.

Then, at the time when the rear end of the recording paper reaches the conveyance roller 12*b*, the conveyance roller 12*b* is reversed, and the recording paper is conveyed to the duplex conveyance path S2 by switchback and then is passed between the transfer roller 10 and the intermediate transfer belt 61 to perform printing. At this time, since a front side and a back side the recording paper are inverted by switchback, when printing is performed, the printing is performed on the side of the inward of the recording paper with a folding line.

Further, the orientation to place the recording paper with a folding line is changed depending on setting of the number of times of the smoothing processing. For example, when the number of times of the smoothing processing is set to be the odd number of times, front and back sides are judged in image formation, so that the orientation to place the recording paper with a folding line on the above manual paper feed cassette 82 is made opposite to the above case.

When the recording paper smoothing processing is not performed at step S12 above, the processing is normal printing processing, and therefore the image forming apparatus sets a bias in normal printing in accordance with image data to be printed, temperature, humidity, the deterioration state of each device and the like (step S21). Then, after moving to step S19, one-side printing or duplex printing for the recording paper is performed in accordance with printing setting.

After printing for the recording paper is performed in this manner, whether or not other printing is to be performed is then confirmed, and when printing is finished (step S20—Yes), the processing is finished. Alternatively, when printing is not finished (step S20—No), after returning to step S12, whether or not the next recording paper smoothing processing is to be performed is judged, and the smoothing processing and the printing processing are continued.

Figure 9:
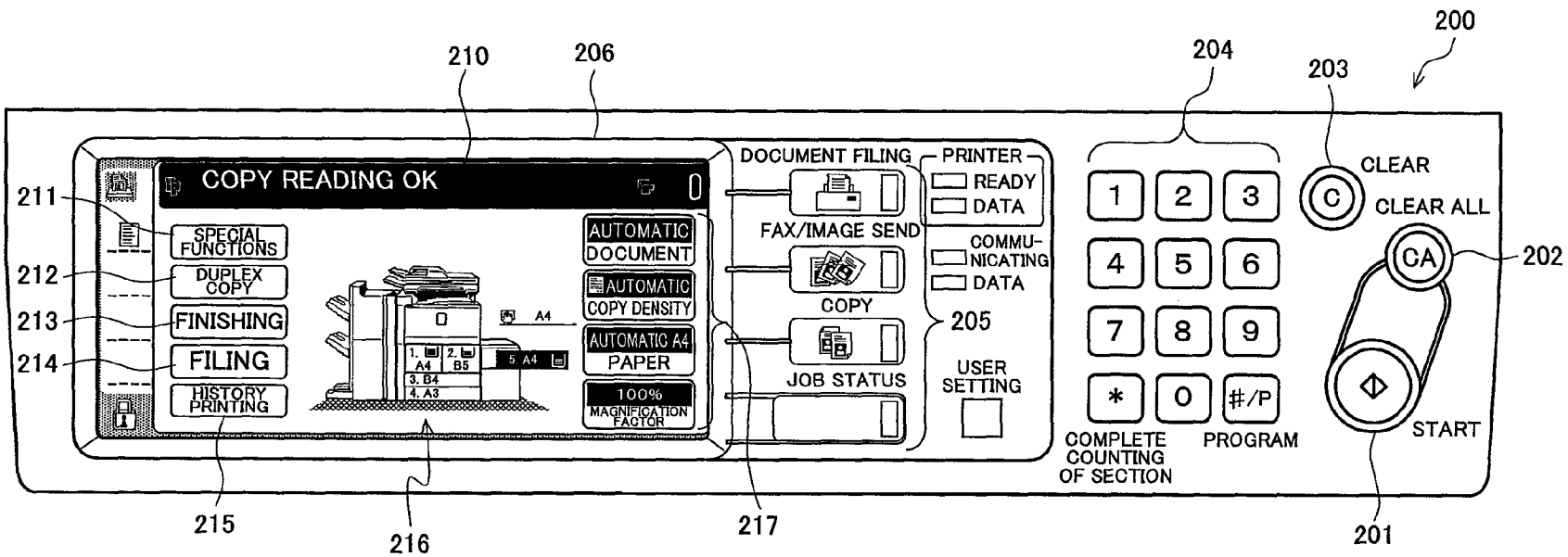
FIG. 9 is a view showing an example of an operation panel of the image forming apparatus.

FIG. 9 is a view showing an example of an operation panel of the image forming apparatus. The image forming apparatus 100 is provided with an operation panel 200 constituting the operation portion and the display portion for performing a user operation. The operation panel 200 is provided with a start key 201, a clear all key 202, a clear key 203 and a numerical keypad 204, and further is provided with a hard key group 205 for setting a function of document filing, fax or copy or confirming the job status, so that the user operation is allowed as appropriate. Further, the operation panel 200 is provided with an operation display portion 206 configured as a touch panel.

On the operation display portion 206, an operation screen 210 for performing image formation processing is able to be displayed. The operation screen 210 of FIG. 9 is an operation screen for performing setting a copy function, on which setting buttons 212 and 213 concerning finishing such as duplex copy and finishing, setting buttons 214 and 215 concerning data save such as filing or automatic temporary save, a state display portion 216 for displaying a state of a paper feed tray, a document setting button 217 for performing various settings of a document and the like are displayed, and further a special function setting button 211 for setting a special function of the image forming apparatus is displayed.

Figure 10:
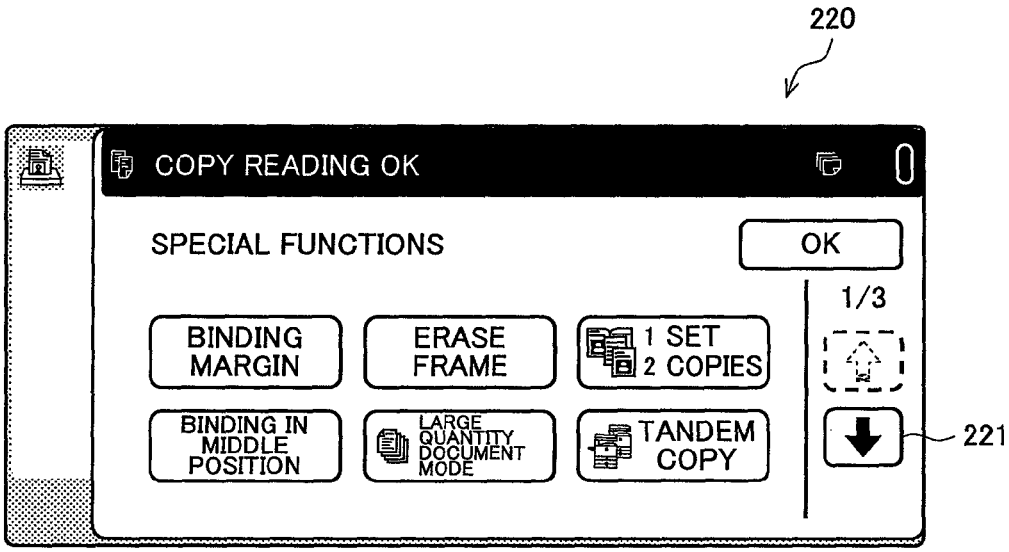
FIG. 10 is a view showing an example of a setting screen of special functions.

When the user operates the special function setting button 211 on the operation screen 210 of FIG. 9, a special function setting screen 220 shown in FIG. 10 is displayed. On the special function setting screen 220, buttons for setting items of various special functions are set. In this example, the special function setting screen has a lot of setting items and is therefore displayed being separated into a plurality of screens. Here, when the user operates a down arrow 221, a next special function setting screen 230 as shown in FIG. 11 is displayed.

Figure 11:
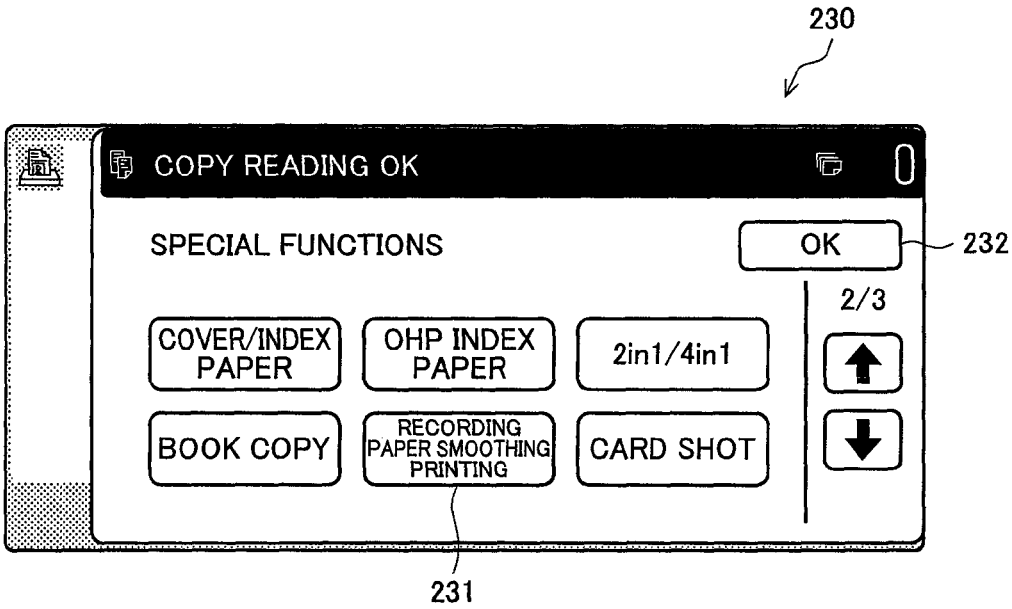
FIG. 11 is view showing another example of a setting screen of special functions.
Figure 12:
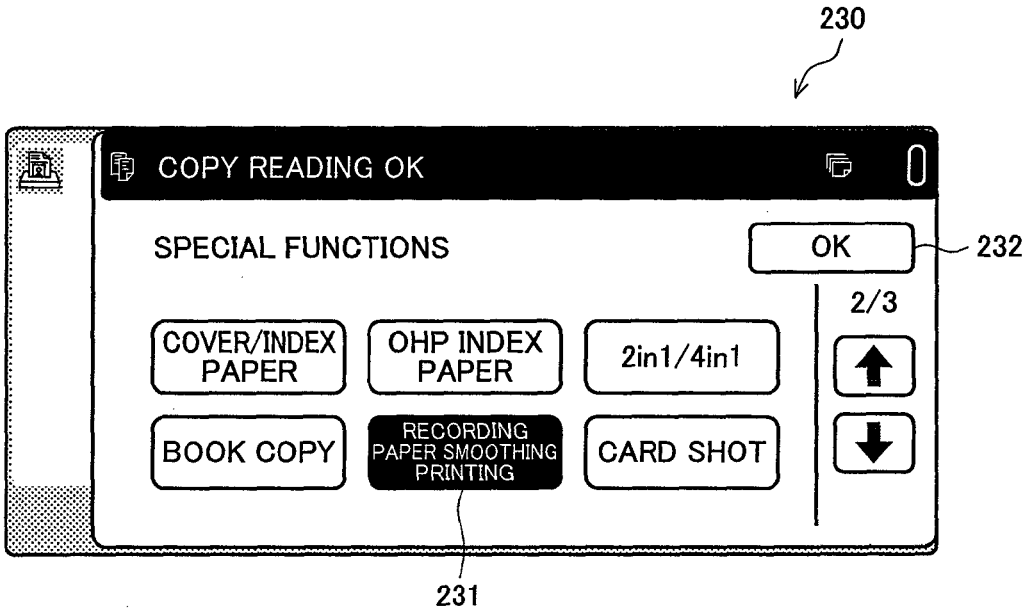
FIG. 12 is a view showing a state where a setting button of recording paper smoothing printing is high-lighted.
Figure 13:
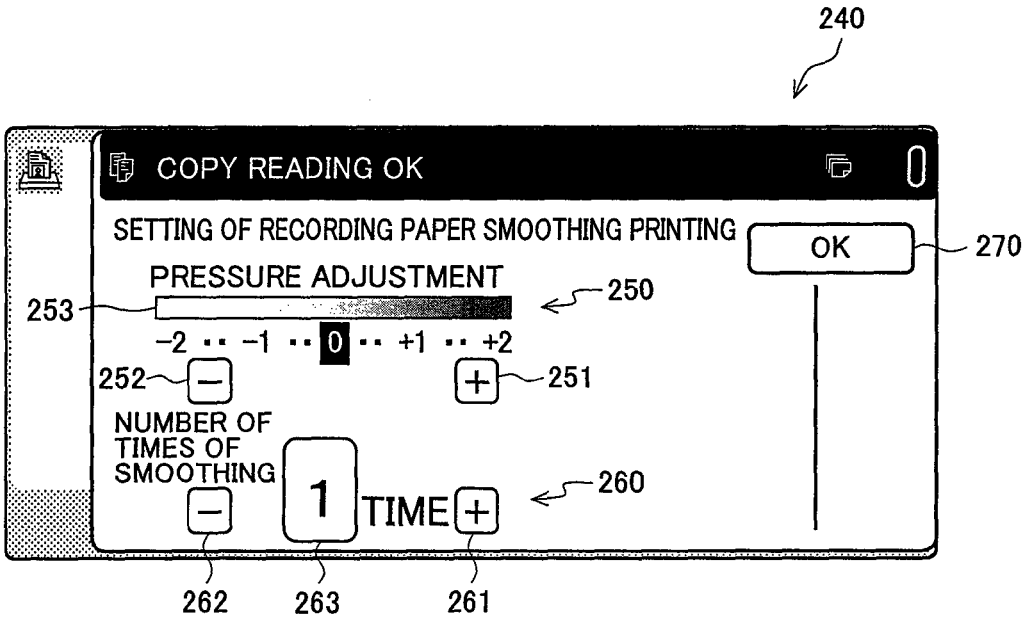
FIG. 13 is a view showing an example of a setting screen of the number of times and pressure of recording paper smoothing processing.

The setting screen 230 of FIG. 11 is provided with a setting button 231 for recording paper smoothing printing. When the user operates this setting button 231, the setting button 231 is highlighted as shown in FIG. 12 to clearly show that setting of recording paper smoothing printing is being selected. By pressing an OK button 232 in this state, the screen moves to a smoothing printing setting screen 240 of FIG. 13. On the smoothing printing setting screen 240, the smoothing processing, that is, pressure when passing a recording paper through the fixing unit 7 for smoothing and the number of times to pass through the fixing unit 7 (the number of times of smoothing) are able to be set by the user.

For example, an increase button 251 and a decrease button 252 for a pressure setting value are provided as a pressure setting portion 250, and when the user operates these buttons as appropriate, it is possible to change pressure force in a stepwise manner. Further, a pressure setting display portion 253 makes it possible to visually confirm the setting state thereof. A relation between the pressure setting value and a pressure adjustment value that is actually set to the fixing unit 7 is determined in advance, and based on the pressure setting value set by the user, the control portion 110 of the image forming apparatus 100 adjusts pressure force of the pressure roller 72 to the heat roller 71 in the fixing unit 7 to execute the smoothing processing.

Further, the smoothing printing setting screen 240 is provided with an increase button 261 and a decrease button 262 for a number of times setting value as a number of times of smoothing setting portion 260, and when the user operates these buttons as appropriate, it is possible to increase or decrease the number of times of smoothing. On a set number of times of smoothing display portion 263, the set number of times of the smoothing processing is shown. Based on the number of times of smoothing that is set, the control portion 110 of the image forming apparatus 100 controls the number of times to pass the recording paper through the fixing unit 7 to execute the smoothing processing.

Figure 14:
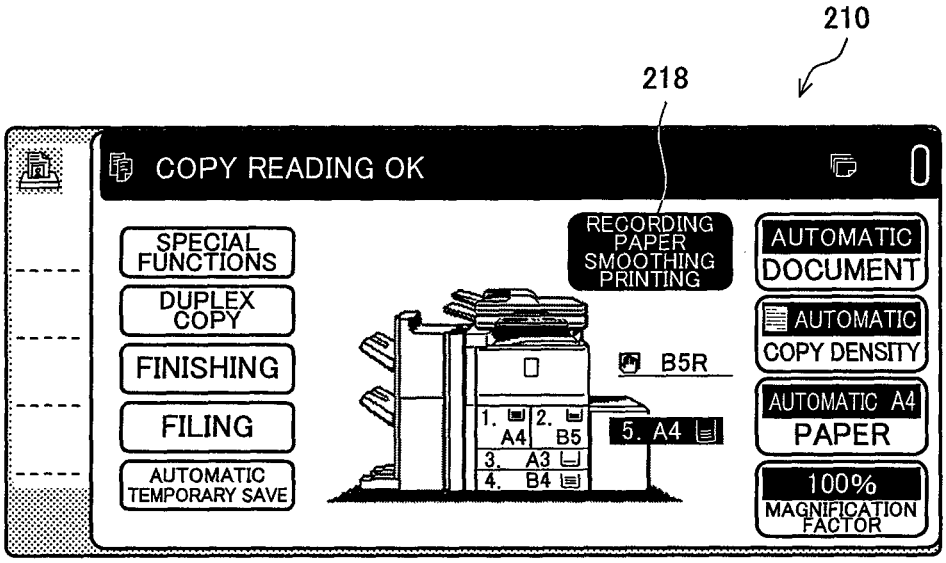
FIG. 14 is a view showing an example of an operation screen showing a state where recording paper smoothing printing is set.
Figure 15A:
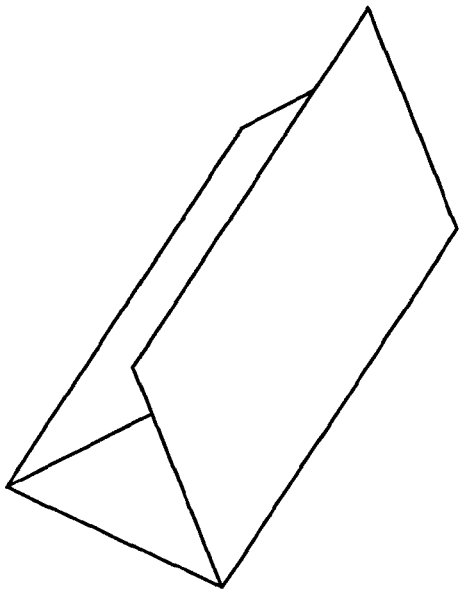
FIG. 15A and FIG. 15B are views for describing a state of a recording paper with a folding line.
Figure 15B:
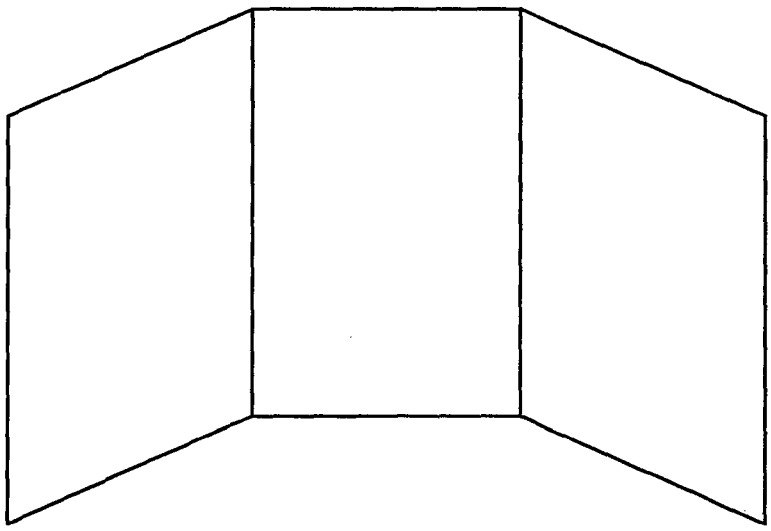

When an OK button 270 of the smoothing printing setting screen 240 is operated, then the screen moves to the operation screen 210 of FIG. 14. Though the operation screen 210 is the same screen as the operation screen 210 shown in FIG. 9, a recording paper smoothing printing setting display portion 210 showing that recording paper smoothing printing is set as a special function is displayed in the state of FIG. 14. With this display, the user is able to confirm that the recording paper smoothing processing is set. By instructing to execute copy in this state, reading of a document image and printing processing are executed, and at that time, after the recording paper is heated and pressed by the fixing unit 7, the read image data is printed.

Further, when setting of recording paper smoothing printing is cleared on the operation screen 210 of FIG. 14, after moving to an operation screen 230 of FIG. 12, by operating the setting button 231 for recording paper smoothing printing again, it is possible to clear that setting. Alternatively, by operating the clear all key 202 provided in the operation panel 200 of FIG. 9, it is also possible to clear the setting of recording paper smoothing printing.

As described above, according to the present invention, it is possible to provide an image forming apparatus capable of performing high-quality image formation without image deterioration, even for a recording paper whose surface smoothness is low because of quality or a form of the recording paper, by making it possible to transfer an image formed on an intermediate transfer member onto the recording paper reliably and stably, and an image forming method.

The invention claimed is:

1. An image forming apparatus comprising a recording paper conveying portion for conveying a recording paper, an image forming portion for performing image formation on the recording paper conveyed by the recording paper conveying portion, and a control portion for controlling the recording paper conveying portion and the image forming portion, wherein the image forming portion has a transfer portion for transferring a toner image formed on an image carrier onto the recording paper, and a fixing portion for heating and compressing the recording paper on which the toner is transferred to fix the toner image to the recording paper, the recording paper conveying portion has a conveyance path for conveying the recording paper heated and compressed by the fixing portion to the transfer portion again, the control portion controls to heat and compress the recording paper by the fixing portion without performing transfer of the toner image by the transfer portion under a predetermined condition, and is configured to set variably the number of times to pass through the fixing portion without performing transfer of the toner image to the recording paper and pressure force of the fixing portion when the recording paper passes through the fixing portion, the control portion conveys the recording paper heated and compressed by the fixing portion without performing transfer of the toner image by the transfer portion to the transfer portion again under the predetermined condition, and when the number of times to pass the recording paper through the fixing portion without performing transfer of the toner image by the transfer portion is set to be an odd number of times, the control portion gives an alarm that a front side and a back side of the recording paper are inverted due to setting of the odd number of times.

2. The image forming apparatus according to claim 1, wherein the transfer portion has a plurality of image carriers, an intermediate transfer belt for transferring the toner image formed on the plurality of image carriers, a transfer roller for transferring the toner image transferred to the intermediate transfer belt onto the recording paper, and a driving mechanism portion for causing the image carriers and the intermediate transfer belt to be in contact with or separated from each other, and the driving mechanism portion separates the image carriers and the intermediate transfer belt from each other under the predetermined condition.

3. An image forming method executed by an image forming apparatus including a transfer portion for transferring a toner image formed on an image carrier onto a recording paper, and a fixing portion for heating and compressing the recording paper on which the toner image is transferred to fix the toner image to the recording paper, comprising a step of heating and compressing the recording paper by the fixing portion without performing transfer of the toner image by the transfer portion, and a transfer step of conveying the recording paper that is heated and compressed to the transfer portion to transfer the toner image onto the recording paper, and wherein under a predetermined condition, the number of times to pass through the fixing portion without performing transfer of the toner image to the recording paper and pressure force of the fixing portion when the recording paper passes through the fixing portion are variably settable at the step of heating and compressing without performing transfer of the toner image, the image forming apparatus conveys the recording paper heated and compressed by the fixing portion without performing transfer of the toner image by the transfer portion to the transfer portion again under the predetermined condition, and when the number of times to pass the recording paper through the fixing portion without performing transfer of the toner image by the transfer portion is set to be an odd number of times, the image forming apparatus gives an alarm that a front side and a back side of the recording paper are inverted due to setting of the odd number of times.

* * * * *

UNITED STATES PATENT AND TRADEMARK OFFICE

CERTIFICATE OF CORRECTION

PATENT NO. : 8,891,988 B2
APPLICATION NO. : 13/600428
DATED : November 18, 2014
INVENTOR(S) : Kenji Takahashi, Tsutomu Yoshimoto and Shuhuji Fujii It is certified that error appears in the above-identified patent and that said Letters Patent is hereby corrected as shown below:

On the Title Page

Insert -- (30), Foreign Application Priority Data
Nov. 8, 2011 (JP).....2011-244192 --.

Signed and Sealed this
Thirty-first Day of March, 2015

Michelle K. Lee

Michelle K. Lee
*Director of the United States Patent and Trademark Office*